US006799707B2

(12) United States Patent
Gibson

(10) Patent No.: US 6,799,707 B2
(45) Date of Patent: Oct. 5, 2004

(54) RECREATIONAL BOARD CARRIER AND THEFT DETERRENT DEVICE

(76) Inventor: Wade L. Gibson, 9797 Perry Way, Westminster, CO (US) 80031

( * ) Notice: Subject to any disclaimer, the term of this patent is extended or adjusted under 35 U.S.C. 154(b) by 257 days.

(21) Appl. No.: 10/172,037

(22) Filed: Jun. 14, 2002

(65) Prior Publication Data

US 2003/0034370 A1 Feb. 20, 2003

Related U.S. Application Data

(60) Provisional application No. 60/298,801, filed on Jun. 15, 2001.

(51) Int. Cl.[7] ..... A45F 3/02

(52) U.S. Cl. ..... 224/609; 224/607

(58) Field of Search ..... 224/609, 580, 224/607, 615, 257, 264, 917; 70/58, 59, 63, 64; 280/815, 814

(56) References Cited

U.S. PATENT DOCUMENTS 3,377,007 A * 4/1968 Gayler, Jr. ..... 224/609
4,135,726 A * 1/1979 Beaver ..... 280/87.042
4,261,493 A * 4/1981 Newman ..... 224/257
4,456,284 A * 6/1984 Saka ..... 280/812
4,676,417 A * 6/1987 Hirschkoff ..... 224/586
4,792,073 A * 12/1988 Jacober ..... 224/614
5,344,056 A 9/1994 Challoner et al.
5,492,254 A * 2/1996 Challoner et al. ..... 224/586
5,499,752 A * 3/1996 Johnson ..... 224/258
5,695,101 A * 12/1997 Frietze ..... 224/250
D390,001 S * 2/1998 Lovelady et al. ..... D3/221
5,730,287 A * 3/1998 Martin ..... 206/315.9
5,746,361 A 5/1998 Johnson
6,012,739 A 1/2000 Weiss et al.
6,199,881 B1 * 3/2001 Wood et al. ..... 280/87.042
6,263,709 B1 7/2001 Kemery et al.
6,311,883 B1 * 11/2001 Greenberg ..... 224/607
6,446,849 B1 * 9/2002 Schleifer ..... 224/258

* cited by examiner

*Primary Examiner*—Stephen K. Cronin
*Assistant Examiner*—Maerena W. Brevard
(74) *Attorney, Agent, or Firm*—Medlen & Carroll, LLP

(57) ABSTRACT

The present invention relates to devices for carrying, storing, and deterring the theft of elongate recreational boards such as snowboards, skis, skateboards, surfboards, and sailboards and the like.

17 Claims, 8 Drawing Sheets

RECREATIONAL BOARD CARRIER AND THEFT DETERRENT DEVICE

This application claims priority to U.S. Provisional Patent Application Serial No. 60/298,801, filed Jun. 15, 2001, incorporated herein by reference in its entirety.

FIELD OF THE INVENTION

The present invention relates to devices for carrying, storing, and deterring the theft of elongate recreational boards such as snowboards, skis, skateboards, surfboards, sailboards and the like.

BACKGROUND OF THE INVENTION

Recreational board sports such as snowboarding have continually grown in their popularity and today are enjoyed international by millions of young and old alike. For example, Olympic officials at the recent Winter Games in the United States reported that the snowboarding events were among the most popular events held at the Games. The exposure gained by the snowboarding community at the recent winter Olympics has consequently fueled an explosion in the number of people beginning to snowboard. However, as more people participate in snowboarding, the limited number of suitable snowboarding resorts are becoming increasingly crowded.

Crowds at popular snowboarding resorts are not only frustrating to those on the slopes, crowds can also encourage the would-be criminal to try and steal other's snowboarding equipment. For example, as the number of people enjoying snowboarding has increased, so has the incidence of equipment theft and vandalization. Moreover, the cumbersome and awkward nature of snowboarding equipment often prohibits the snowboarder from carrying her equipment while stopping to eat, buy lift tickets, or to rest in the lodge. Thus, the snowboarder must leave her equipment in common areas, such as against the wall of a ski lodge, and hope that no one steals her snowboard, adding to the risk of equipment theft and damage.

In addition to worrying about the theft or damage of her equipment once at her destination, the snowboarder, in particular, and other recreational board user more generally, faces difficulties transporting her bulky equipment through hotel lobbies, parking structures, and airport terminals often while also attempting to carry luggage and other personal items.

A number of devices are known to improve the portability of recreational boards. Typically, the lightweight construction of these devices does little to deter thieves and also affords little protection from damage during transportation and storage. Other devices are designed to deter the theft of recreational board equipment. Most of these devices feature a device (e.g., a chain or wire) for releasably engaging the recreational board to an immobile rack or locker. These devices, however, generally fail to provide recreational board carriers and storage devices that both protect the recreational boards during transport and deter theft.

Thus, what are needed are more convenient devices for carrying recreational boards (e.g., snowboards, skateboards, skis, surfboards and the like) and more secure devices for preventing their theft.

SUMMARY OF THE INVENTION

The present invention relates to devices for carrying, storing, and deterring the theft of elongate recreational boards such as snowboards, skis, skateboards, surfboards, sailboards and the like.

In one embodiment, the present invention comprises a carrying case comprising: a first receptacle located at the proximal end of the carrying case; a second receptacle located at the distal end of the carrying case; a support member comprising an elongated first portion having a first end and a second end, and an elongated second portion having a first end and second end, wherein the first end of the first portion of the support member is attached to the first receptacle, and the first end of the second portion of the support member is attached to the second receptacle; a lock mechanism comprising a first and a second portion, wherein the first portion of the locking device is attached to the second end of the first portion of the support member, and the second portion of the locking device is attached to the second end of the second portion of the support member; and a leash comprising an elongated portion and a first end and a second end, wherein the first end of the leash is slidingly attached to the second end of the first portion of the support member, and the second end of the leash is slidingly attached to the second end of the second portion of the support member. The present invention is not limited by the construction nor configuration of the receptacles used. Indeed, in some embodiments of the present invention, the receptacles are formed by 2 or more opposing sets crisscrossing support members such that a roughly "X" shaped configuration of support members is provided across the front (or back) of the recreational board. In some of these embodiments, the two or more sets of opposing support members are releasably attached at the meeting point at the center of the recreational board being carried/secured.

In additional embodiments, the carrying case additionally comprises f) a carrying strap comprising an elongated portion and a first end and a second end, wherein the first end of the carrying strap is pivotally attached to the first receptacle, and the second end of the support member is pivotally attached to the second receptacle.

In some embodiments, the carrying strap additionally comprises a device for adjusting the length of the carrying strap (e.g., VELCRO, Velcro USA Inc., Manchester, N.H., buckle, clasp, cinch, etc.).

In yet other embodiments, the carrying strap additionally comprises a section of padding material (e.g., a shoulder pad).

In still other embodiments, the first and the second receptacles comprise an elastic material, while in other embodiments, the first and the second receptacles comprise a cut-resistant material. In yet other embodiments the first and the second receptacles further comprise shock absorbing material.

Additionally, in some embodiments, the first and the second receptacles further comprise a device (e.g., VELCRO, elastic bands, draw string, zippers, etc.) for securing the receptacles around the ends of an object (e.g., a recreational board).

The present invention contemplates that preferred embodiments of the carrying case be used to carry and secure recreational boards (e.g., snowboards, skateboards, surfboards, sailboards, snowshoes, water skis, and snow skis) and related equipment. When embodiments of the present invention are used to carry and secure recreational board equipment with more than one section or board piece (e.g., snow skis, water skis, etc.) the present invention contemplates that two receptacles be provided, one at each of the distal and proximal ends of the carrying case such these receptacles can releasably secure the respective distal and proximal ends of the recreational board. In other of these embodiments, proximal and distal ends provide bifurcated receptacles comprising two pouch like portions for receiving the respective ends of recreational boards.

In preferred embodiments, the components of the present invention (e.g., receptacles, support members, leash, etc.)

are constructed of, or coated with, cut-resistant materials. In other preferred embodiments, the components of the present invention (e.g., receptacles, support members, leash, etc.) are constructed of, or coated with, reflective and/or other high-visibility materials.

The present invention further contemplates providing carrying cases marked with commercial or user selected text, messages, and graphics (e.g., company logos and trademarks, advertising slogans, and the like).

Still other embodiments of the present invention provide recreational board carrying cases comprising: a first receptacle located at the proximal end of the carrying case; a second receptacle located at the distal end of the carrying case; a support member comprising an elongated first portion having a first end and a second end, and an elongated second portion having a first end and second end, wherein the first end of the first portion of the support member is attached to the first receptacle, and the first end of the second portion of the support member is attached to the second receptacle; a lock mechanism comprising a first and a second portion, wherein the first portion of the locking device is attached to the second end of the first portion of the support member, and the second portion of the locking device is attached to the second end of the second portion of the support member; and a leash comprising an elongated portion and a first end and a second end, wherein the first end of the leash is slidingly attached to the second end of the first portion of the support member, and the second end of the leash is slidingly attached to the second end of the second portion of the support member.

In some of these embodiments, the recreational board carrying case additionally comprises f) a carrying strap comprising an elongated portion and a first end and a second end, wherein the first end of the carrying strap is pivotally attached to the first receptacle, and the second end of the support member is pivotally attached to the second receptacle. The present invention contemplates that the recreational board carrying case be used to carry recreational board selected from the group consisting of snowboards, skateboards, surfboards, sailboards, snowshoes, water skis, and snow skis. The present invention is not limited, however, to carrying recreational board equipment. Indeed, the present invention can be optimized to fit over the respective proximal and distal ends of a wide range of consumer and commercial products which are often carried by their users (e.g., personal electronic equipment including, mobile phones, pagers, laptop computers, etc., and commercial items).

Yet another embodiment of the present invention provides a carrying case and anti-theft device comprising: a first receptacle located at the proximal end of the carrying case; a second receptacle located at the distal end of the carrying case; a support member comprising an elongated first portion having a first end and a second end, and an elongated second portion having a first end and second end, wherein the first end of the first portion of the support member is attached to the first receptacle, and the first end of the second portion of the support member is attached to the second receptacle; a lock mechanism comprising a first and a second portion, wherein the first portion of the locking device is attached to the second end of the first portion of the support member, and the second portion of the locking device is attached to the second end of the second portion of the support member; and a leash comprising an elongated portion and a first end and a second end, wherein the first end of the leash is slidingly attached to the second end of the first portion of the support member, and the second end of the leash is slidingly attached to the second end of the second portion of the support member.

Other advantages, benefits, and preferable embodiments of the present invention will be apparent to those skilled in the art.

DESCRIPTION OF THE FIGURES

The following figures form part of the specification and are included to further demonstrate certain aspects and embodiments of the present invention. The present invention is not intended to be limited however to the embodiments specifically recited in these figures.

DEFINITIONS

Figure 1:
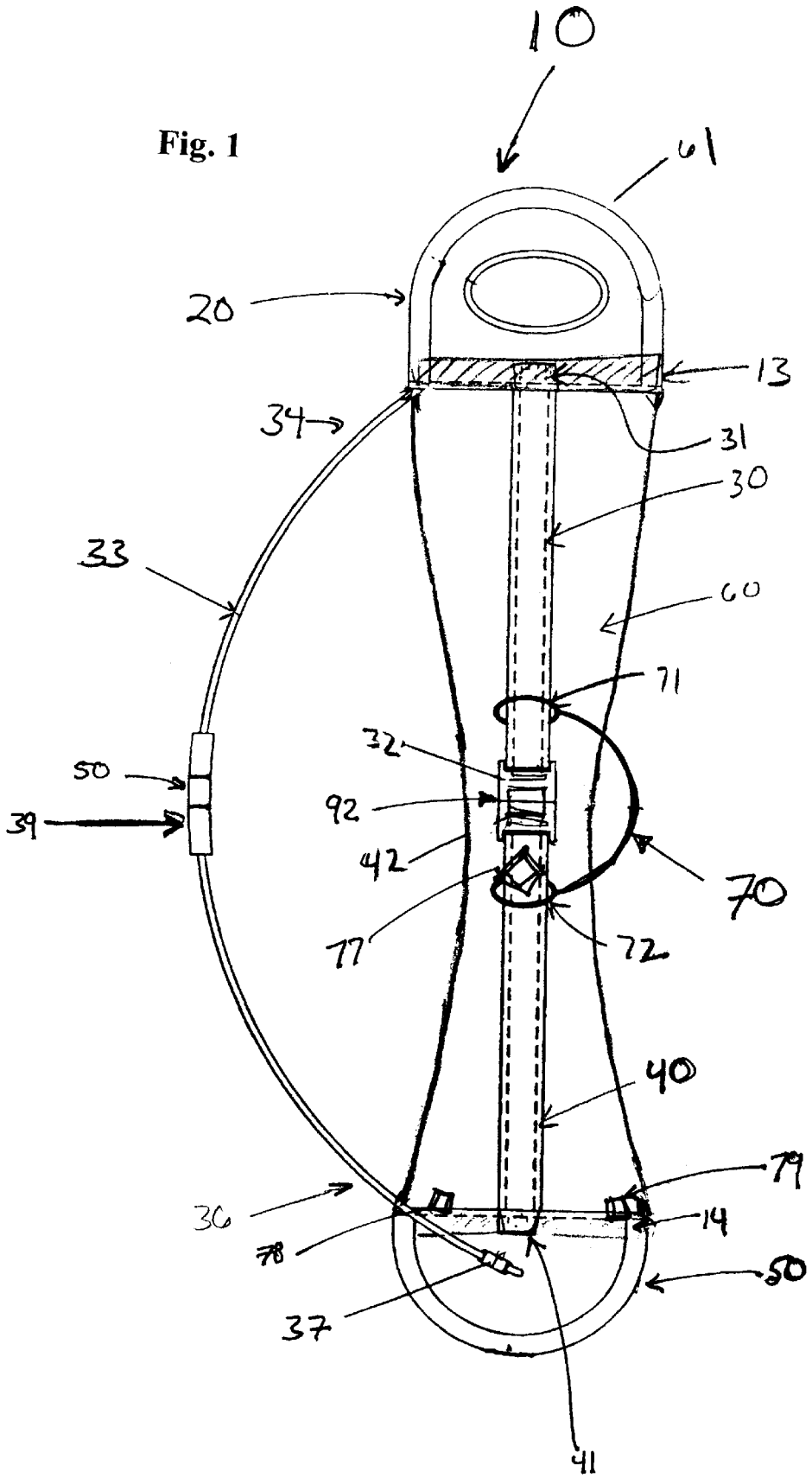
FIG. 1 shows a perspective view of the anterior surface of one embodiment of the present invention.
Figure 2:
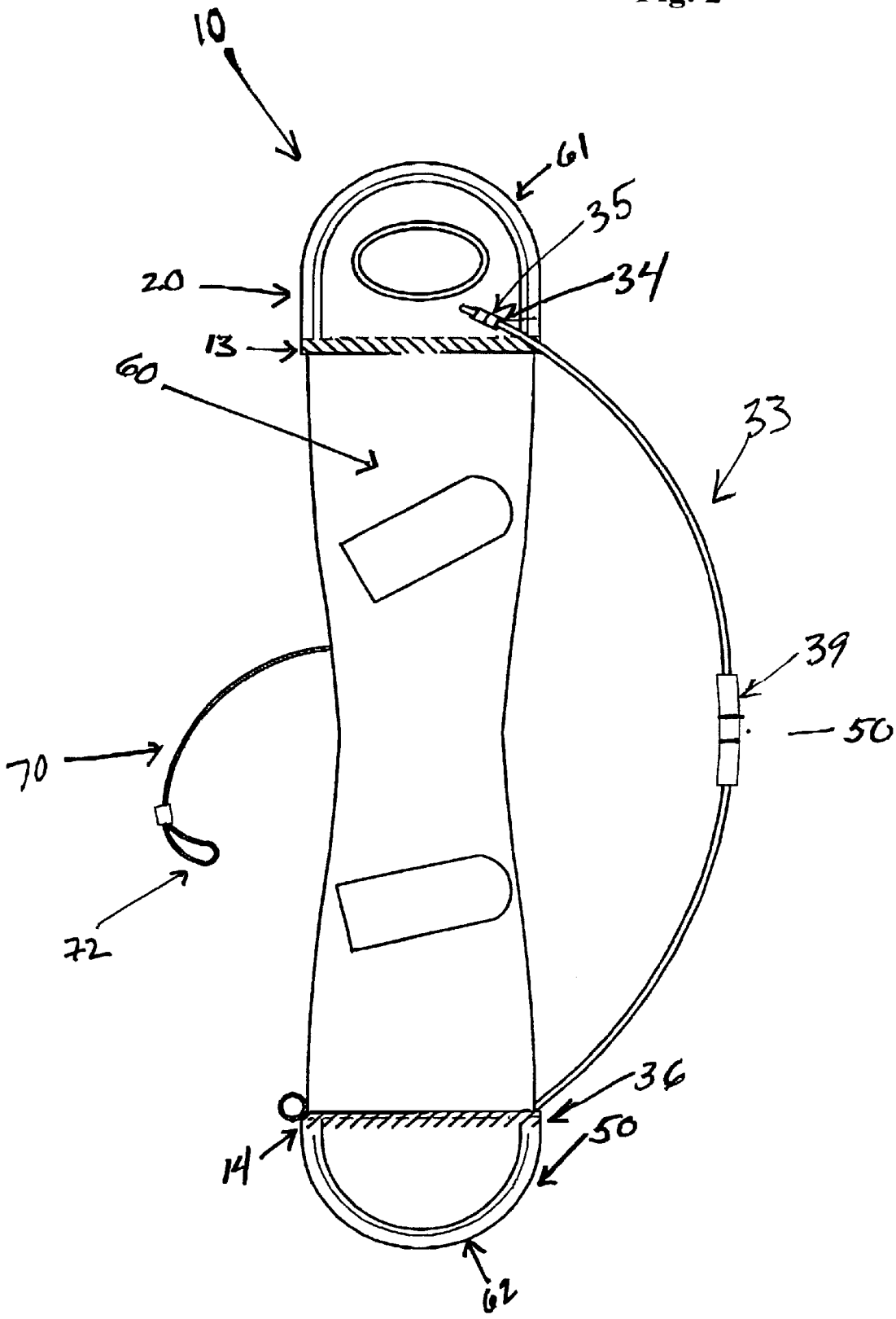
FIG. 2 shows a perspective view of the posterior surface of one embodiment of the present invention.

To facilitate an understanding of the present invention, a number of terms and phrases are defined below.

As used herein, the term "receptacle" refers to a semi-enclosed device (e.g. a pouch) for receiving and holding an object, or a portion of an object, inserted therein. In a preferred embodiment, the present invention provides one or more receptacles for receiving and holding the ends of an elongate recreational board.

As used herein, the term "support member" refers to a structure (e.g., wire, band, strap, and the like) used to connect the distal and proximal end.

As used herein, the term "cut-resistant material" refers to any material that resists abrasions and/or attempts to sever the material (e.g., KEVLAR, plastics, metals, composite materials, and the like). Furthermore, as used herein, materials that are not inherently cut-resistant may be made cut-resistant by coating, wrapping, or integrating one or materials that are cut-resistant with the non-cut-resistant material.

DESCRIPTION OF THE INVENTION

The present invention relates to devices for carrying, storing, and deterring the theft of elongate recreational boards such as snowboards, skis, skateboards, surfboards, sailboards and the like. There have been a number of attempts to provide carrying devices for elongate recreational boards that meet one or more these objectives, however, until the present invention, these efforts all fell short in providing devices with each of the features and benefits of the present invention.

Some embodiments of the present invention provide a recreational board carrying case and anti-theft device. In preferred embodiments, the present invention provides a recreational board carrying case and anti-theft device that allows the user to releasably secure the board to stationary objects (e.g., racks, poles, and the like).

In further embodiments, the present invention provides a recreational board carrying case and anti-theft device that provides the user with a sense of security from the theft of their board, even when the device is not secured to a stationary object, since a recreational board that is secured within the carrying case is inoperable.

In still further embodiments, the present invention provides a recreational board carrying case and anti-theft device that helps to protect the recreational board from damage.

Other embodiments of the present invention provide a recreational board carrying case and anti-theft device that allows the user to more conveniently transport their recreational board and other associated items (e.g., ski gloves, goggles, lift tickets, etc.).

Additional embodiments of the present invention provide a recreational board carrying case and anti-theft device that allows the user to easily store (e.g., hang) their board when not in use.

In some embodiments, the present invention provides a recreational board carrying case and anti-theft device that converts to a self-contained carry along pouch for storing unused components of the carrying case (e.g., leash device) or other items (e.g., ski gloves, goggles, lift tickets, etc.).

Still other embodiments and advantages of the present invention will become obvious to the reader. These additional embodiments and advantages of the present invention are specifically contemplated to be within the scope of the present invention. Moreover, it is to be understood that the present invention is not limited to carrying any particular item(s) and finds use in carrying and deterring the theft of a wide array of items that are suitable for carrying by various iterations and permutations of the present invention (e.g., portable electronics equipment, such as laptop computers, mobile phones, personal audio and video devices, and personal information managers, etc.).

In a preferred embodiment, the present invention provides an elongate recreational board carrying case and anti-theft device having proximal (e.g., top) and distal (e.g., bottom) ends, and anterior (e.g., front) and posterior (e.g., back) surfaces. In certain embodiments, the present invention further comprises two semi-circular or ovoid shaped receptacles (e.g., pouches) placed at opposing ends of the carrying case (e.g., one receptacle at the proximal end, and one receptacle at the distal end of the recreational board carrier) such that the proximal receptacle releasably receives a first end of a recreational board and the distal receptacle releasably receives a second end of the recreational board. Accordingly, in particularly preferred embodiments, the receptacles substantially correspond to the shape and dimensions of a first and second end of a recreational board (e.g., snowboards, skis, sailboards, surfboards, skateboards and the like).

In some embodiments of the present invention, the receptacles comprise cut or abrasion resistant materials (e.g., fabrics) comprising synthetic fibers (e.g., poly(p-phenyleneterephthalamide) derivatives [e.g., KEVLAR, du Pont Chemical Co., Wilmington, Del.], ballistic nylons, polyester derivatives [e.g., DACRON, du Pont Chemical Co.], extended chain polyethylene fibers [e.g., SPECTRA, Honeywell, Corp., Morristown, N.J.]), or suitable metal wires and bands. In some embodiments, the receptacles comprise materials (e.g., fabrics) constructed from natural fibers (e.g., cotton, wool, hemp, and silk). In still further embodiments, the receptacles comprise shock absorbing and cushioning materials (e.g., high density polyurethane foams, ethylene vinyl acetate (EVA) of various densities, neoprene rubbers, high viscosity gels [e.g., silicone gels], and the like). The present invention is not intended, however, to be limited to construction consisting of any one or more the above-mentioned materials. Indeed, any suitable material may be used in the manufacture of the disclosed recreational board carrier and anti-theft device. It is contemplated that the manufacturer of the disclosed invention will select each material used therein upon consideration of that material's aesthetic and manufacturing qualities (e.g., cost, availability, workability, etc.) as well as the contemplated material's fitness for its intended purpose (e.g., the material's strength, cut-resistance, shock absorption, durability, weight, hydrophobicity, reflectiveness, etc.).

In some embodiments of the present invention that comprise cut or theft resistant materials, the present invention contemplates that the theft deterring qualities of the device are increased. Likewise, in some embodiments comprising abrasion resistant and shock dampening materials, it is contemplated that the protective qualities of the device are likewise increased. Thus, in some preferred embodiments, the design and construction of present invention provides damage resistant and theft deterring recreational board carriers.

Certain embodiments of the present invention further comprise one or more components (e.g., straps, wires, rings, or bands) made of theft-deterring/resistant materials (e.g., KEVLAR, SPECTRA, metal wire or banding, etc.) incorporated (e.g., sown, glued, etc.) into the receptacles and/or support members. In certain preferred embodiments that comprise theft-deterring materials incorporated into the receptacles, the materials are shaped to snugly fit around the circumference of the recreation board when the board is fitted into the respective receptacles. It is further contemplated that in some of embodiments, when the receptacles are fitted over the ends of a recreation board (e.g., a snowboard or skateboard) that device's components and anti-theft materials reduce the possibility of the device forcibly being removed from the recreational board.

The disclosed recreational board carrier and anti-theft device is not limited, however, to incorporating theft-resistant material only in the disclosed receptacles. Indeed, in some embodiments theft-resistant materials (e.g., KEVLAR, SPECTRA, metal wire or banding, etc.) are incorporated into one or more of the other components of the disclosed carrier devices (e.g., shoulder straps, support members, etc.).

Figure 3:
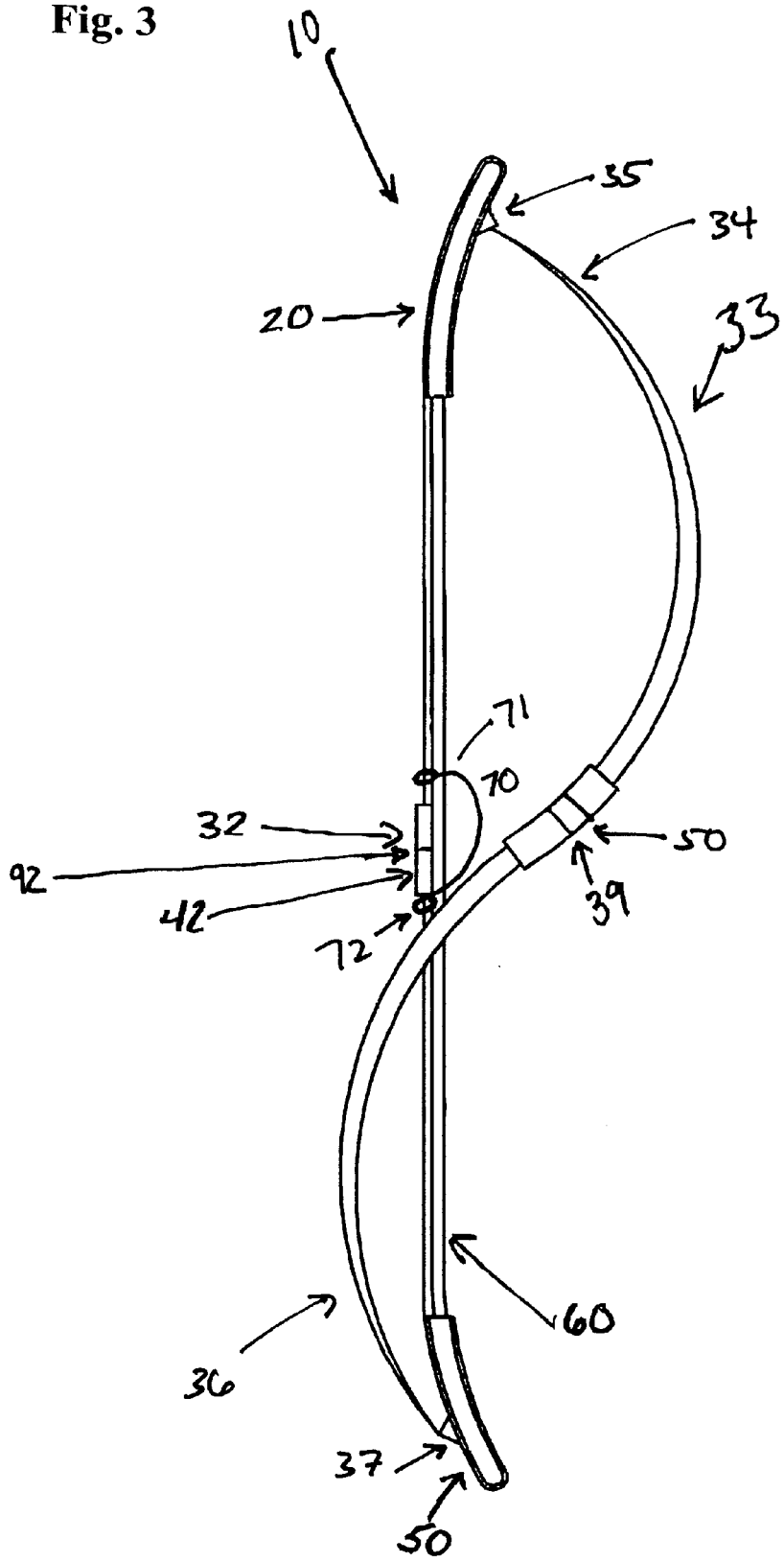
FIG. 3 shows side view of one embodiment of the present invention.
Figure 7:
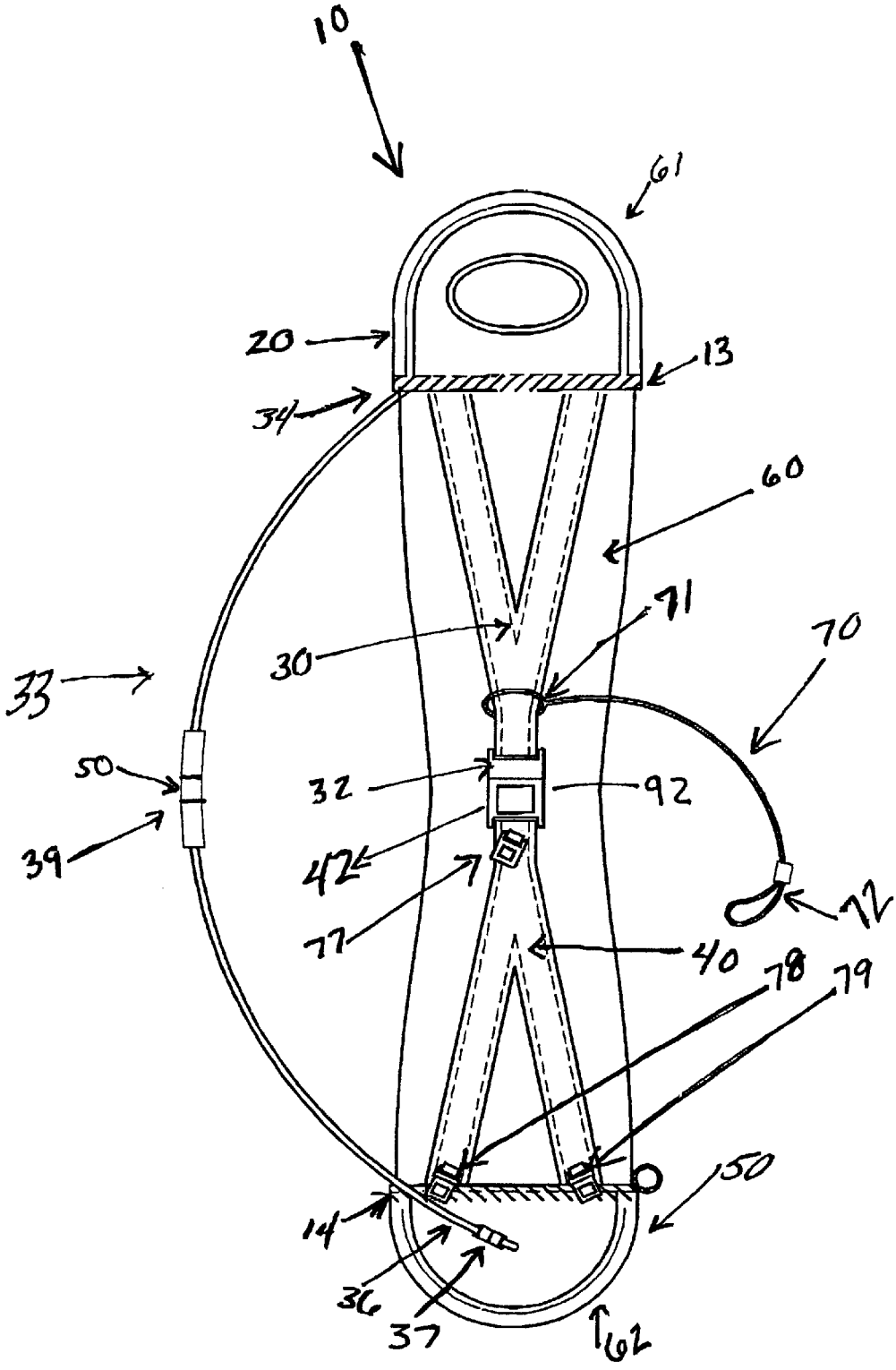
FIG. 7 shows a perspective view of the anterior surface of one embodiment of the present invention.

Preferred embodiments of the present invention further comprise support members that extend from the distal and proximal receptacles such that a first end of each respective support member is affixed (e.g., permanently or non-permanently) to one of the receptacles and a second end of each respective support member is positioned so as to meet at a position substantially in the center of the elongate recreational board carrier device. (See e.g., FIGS. 1, 3, and 7). The Support members are not intended to be limited, however, to a particular number or configuration. Indeed, any arrangement or number of support members may be employed provided that the proximal and distal receptacles are releasably attached via the support members. In some embodiments of the present invention comprise two support members. Still other embodiments comprise three or more support members. Still further embodiments provide a yoke shaped configuration of two or more support members attached to one or both of the receptacle ends.

In some of embodiments, the support members comprise straps comprising abrasion and/or cut-resistance materials similar to the materials disclosed in regard to certain embodiments of the receptacle of the present invention. Accordingly, some embodiments of the present invention incorporate theft-resistant materials (e.g., KEVLAR, SPECTRA, metal wire or bands) into the support members. The present invention contemplates that incorporating theft-resistant materials into the construction of the support members increases the theft resistance of the carrier device.

In particularly preferred embodiments, the second ends of the support members are releasably attached by a locking device. In some of these embodiments, the locking device comprises two halves that are releasably joined together. In other of these embodiments, the locking device comprises a tensioning device that allows the user to adjust the length of one or more support members so as to bring the distal and proximal receptacles into a snug fit around the encompassed recreational board. In still further embodiments, the locking device comprises a first piece wherein the second end of one or more support members are mated into the locking device and are releasably retained.

In some embodiments, the locking device comprises a key lock mechanism. In other embodiments, the lock mechanism comprises a combination lock mechanism. In still further other embodiments, the lock device comprises a mechanism operated by entering (e.g., via a keypad, magnetic reader, keyless entry, or the like) a preset code into lock mechanism. The present invention is not intended to be limited, however, by the type of locking device used. Many different types of lock device are suitable for use in the present invention. Moreover, some embodiments of the present invention contemplate using more than one locking device for redundancy.

In some embodiments, the locking device is separated from the surface of the recreational board being held by a shock absorbing material (e.g., foam cushioning), thus, preventing the locking device from damaging the surface of the recreational board. In some of these embodiments, this shock absorbing material is attached to the second end of one/or both support members. In other embodiments, the shock absorbing material is wrapped around, or attached to, the locking device.

Preferred embodiments of the present invention, further comprise an anti-theft leash that slindingly fits over the locking device and support members. In preferred embodiments, the anti-theft leash comprises a cut and/or abrasion resistant material having a elongated central portion and a first and a second end each of which terminates in a loop, such that the anti-theft leash has a first loop end and second loop end. In some of these embodiments, the first loop end of the anti-theft leash is placed around the second end of a first support member and the second loop end of the anti-theft leash is placed around the second end of a second support member so that when the support members are releasably joined by the locking device, the anti-theft leash may be releasably secured around a fixed object (e.g., ski rack). In other embodiments, one or both of the first and second ends of the anti-theft leash are releasably attached to the support members by a locking device. Regardless of the device used to attach the anti-theft leash to the support members and locking device, in preferred embodiments of the present invention the anti-theft leash has sufficient length such that the carrier device can be easily fitted over the recreational board and then locked and unlocked to stationary objects.

In particularly preferred embodiments of the present invention, the anti-theft leash comprises a cut-resistant material (e.g., plastic or metal wire) of sufficient diameter and strength to resist abrasions and cutting. In some of these embodiments, the anti-theft leash further comprises an outer sheath (e.g., coating) comprised of a material (e.g., TEFLON, du Pont Chemical Co., Wilmington, Del.) that further deters the theft of the recreational board. In still other embodiments, the anti-theft leash comprises a cushioning material (e.g., soft rubber, nylon, closed cell foam) that reduces damage to the recreational board from its contact with the anti-theft leash.

In still further embodiments, the recreational board carrier and theft-deterrent device of the present invention present further comprises a carrying strap (e.g., a sling) that allows the user to conveniently distribute the weight of the recreation board over their shoulder(s). In preferred embodiments, the carrier strap is attached either permanently or removably to the anterior side of the carrier device at the proximal end and to the posterior side of the device at the distal end of the carrier, however, any arrangement or orientation of the carrying strap in relation to the carrier device is within the scope of the present invention. In additional preferred embodiments, the carrying strap is comprised of two or more sections. In still other preferred embodiments, the carrying strap further comprises a pad for cushioning and helping to position the weight of the carrier device and recreational board when supported over the user's shoulder(s). In yet other preferred embodiments, the carrying strap comprises a device (e.g., VELCRO, buckle, clasps, etc.) to adjust the length/tension of the carrying strap. In some embodiments, the carrying strap comprises a material that is cut and/or abrasion resistant (e.g., nylon, KEVLAR, SPECTRA, metal wire or bands). The carrying strap is not intended to be limited, however, to construction comprising any one particular material.

Figures 4A, 4B:
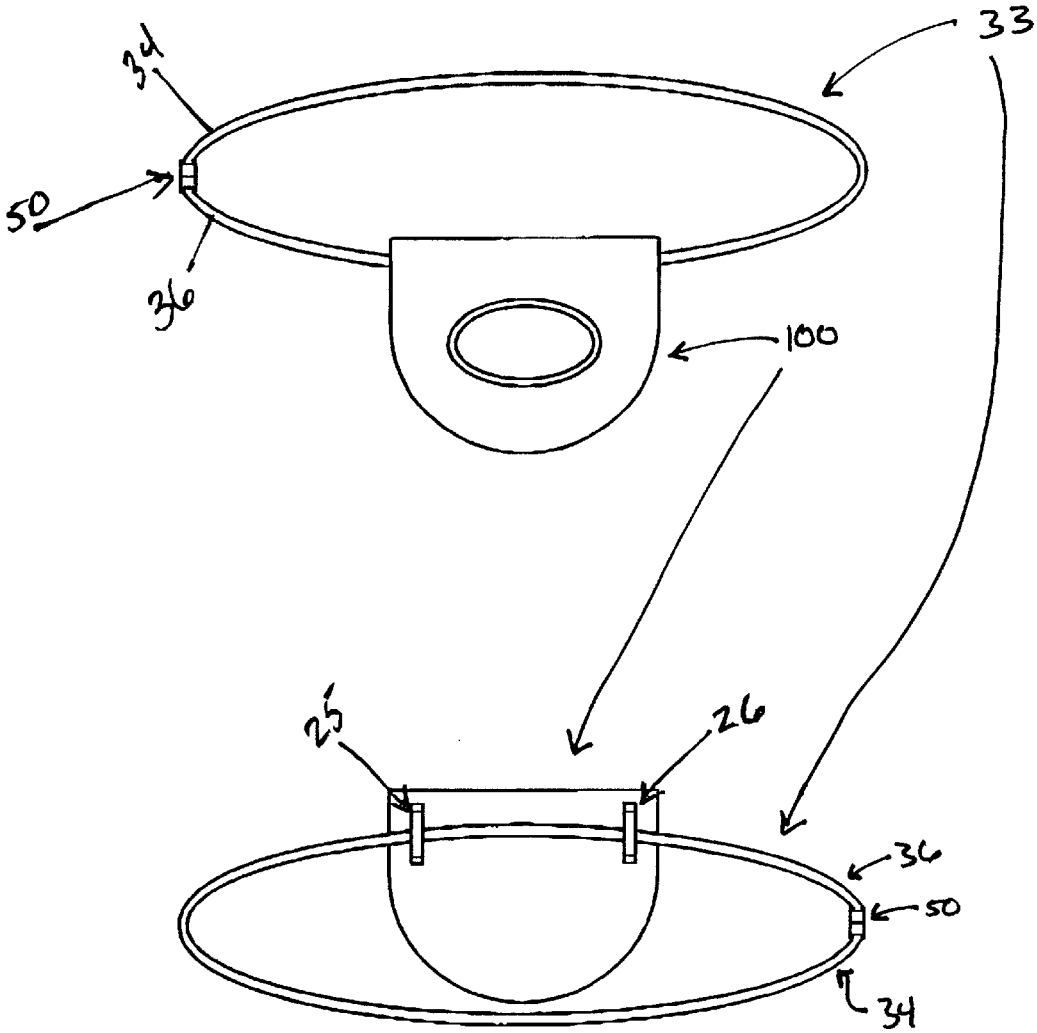
FIGS. 4A and 4B show perspective views of the anterior surface (FIG. 4A) and the posterior surface (FIG. 4B), respectively, of one embodiment of the present invention converted for use a carrying pouch worn on the user's waist.
Figure 5A:
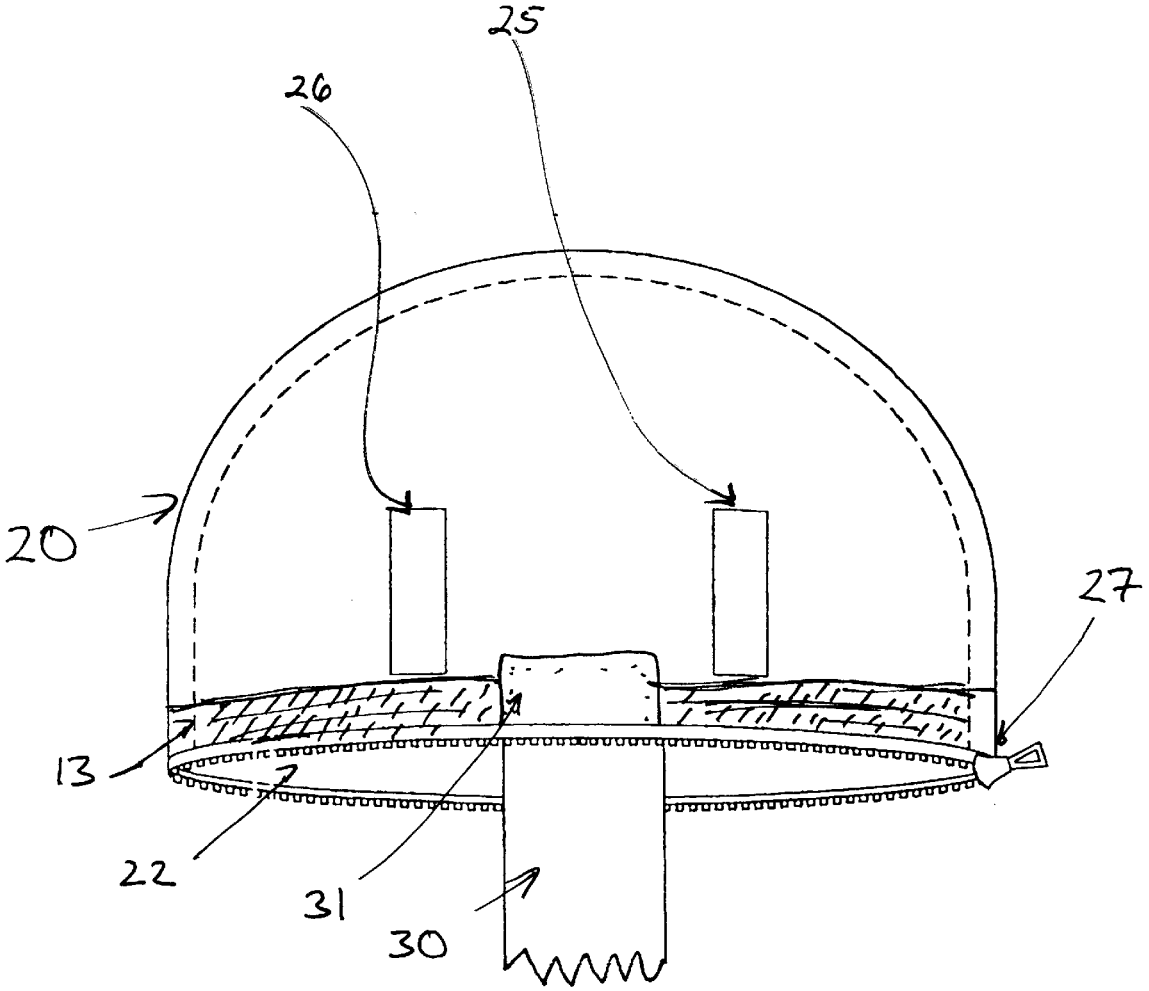
FIG. 5A shows a perspective view of the proximal end of one embodiment of the present invention.
Figure 5B:
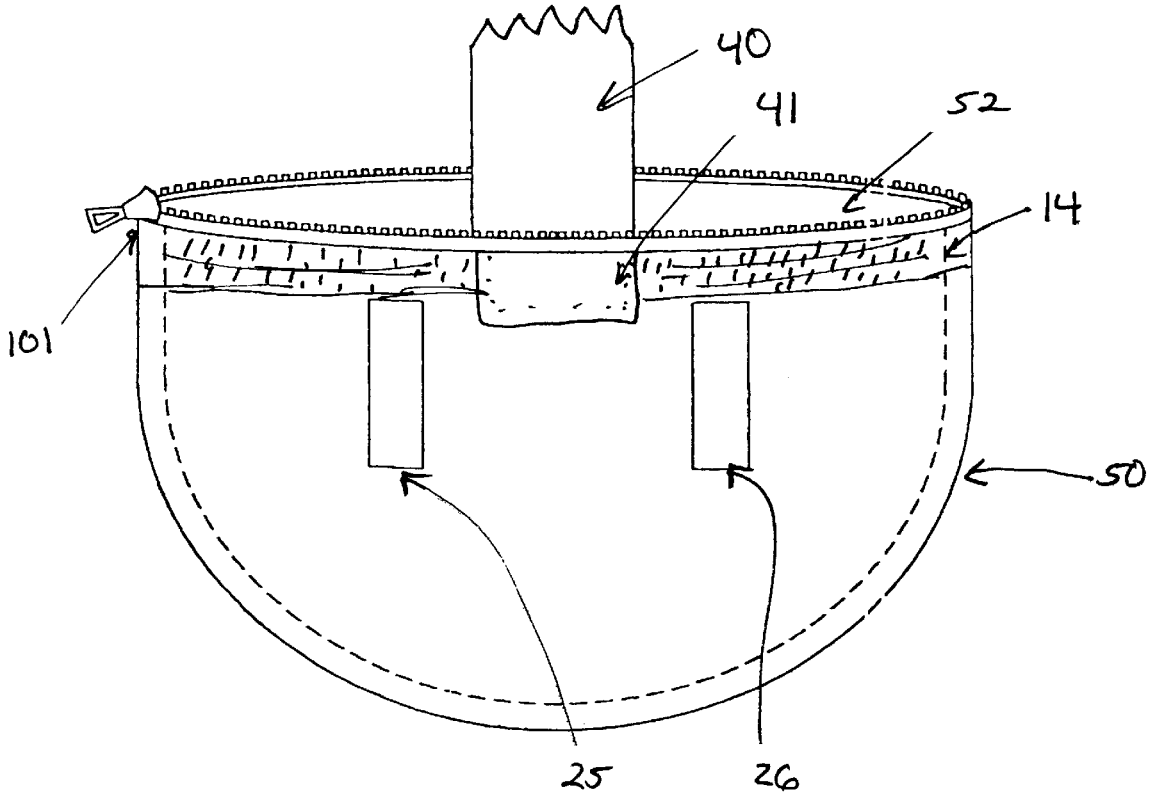
FIG. 5B shows a perspective view of the distal end of one embodiment of the present invention.

In particularly preferred embodiments, one of the receptacles (e.g., the proximal receptacle) of the recreational board carrier device serves as a compartment or pouch for carrying the device when it is not in use. For example, as illustrated in FIGS. 4A and 4B, the proximal receptacle of the carrier device can be positioned so that it fits into the distal receptacle, thus forming a carrying pouch that the user can wear. The carrier device can also be provided with additional pockets or storage spaces having a closure (e.g., a zipper, buttons, snaps, VELCRO, etc.) to secure the entrance to the storage space. In preferred embodiments, a closure is also provided to secure the carrier device when it is being stored. In other preferred embodiments, one or more carrying strap(s) are used to hold the stored carrier device against the user's waist in a manner similar to a fanny pack. In certain other preferred embodiments, one or more carrying strap(s) are used to holed the stored carrier device against the user's back in a manner similar to a backpack. The present invention contemplates that storing the carrier device when not in use provides the user with a convenient and readily accessible means for keeping the carrier device close at hand when engaged in sport, as well as providing additional storage space for personal items (e.g., money, identification, lift tickets, water bottles, and the like). One advantage to storing the carrier device in this manner is that the user is able to maintain her balance and to keep her hands free while enjoying using her recreational board. In certain embodiments, the carrier device is stored by turning a first receptacle inside out and inserting the second receptacle inside the first. In other embodiments, the second receptacle is stored within the first receptacle without turning the first receptacle inside out.

Those skilled in the art will appreciate that the disclosed recreational board carrier may be constructed out of any suitable materials. One consideration when selecting suitable materials for construction of the recreational board carrier is that in preferred embodiments of the invention, the device converts (e.g., folds, rolls, etc.) into a carrier pouch as illustrated in FIGS. 4A and 4B.

In some embodiments, the present invention is constructed of materials that are vivid, reflective, fluorescent. In some embodiments, the materials contemplated for use in present invention are readily marked (e.g., painted, dyed, embroidered, etc) with lettering and graphics. In some of these embodiments, the present invention is marked with logos and trade or service marks, insignias, or other graphics from one or more commercial entities (e.g., sporting goods companies, sports teams, recreational facilities or resorts, professional athletes, etc.) or non-commercial entities (e.g., sport federations and associations, amateur athletes, device users). The present invention is not intended to be limited, however, by the nature of groups or individuals or by the information being presented on the disclosed devices. In still further embodiments, the present invention contemplates that advertising and product endorsements messages are presented on the present invention, thus, the present invention further contemplates a method of doing business by selling or leasing commercial message space (e.g., advertising) on the disclosed devices. In some embodiments the present invention is marked with reflective material (e.g., reflective tapes and threads).

Exemplary Embodiments

Although the provided figures illustrate the present invention used in connection with snow boarding equipment, it is contemplated that the present invention can be used to carry other types or elongate recreational boards, such as, for example, snow skis, water skis, surfboards, sailboards, skateboards, and like articles. Thus, in this sense, the provided figures only illustrate some of the contemplated embodiments of the present invention. It is contemplated that those skilled in the art can adapt the present invention to carry other types of recreational and elongate articles to achieve the advantages of the present invention.

For convenience, the following non-limiting conventions have been adopted for describing the components of the particular embodiments illustrated. As used herein, the proximal end (e.g., top) of the recreational board carrying device corresponds to the end of the recreational board the user faces when using the recreational board, consequently, the distal end (e.g., bottom) of the carrying device corresponds to the opposite end of the recreational board. As used herein, the anterior surface (e.g., front) of the recreational board carrying device corresponds to the plane of the recreational board contacted by the user when using the board, consequently, the posterior surface (e.g., back) of carrying device corresponds to the opposite plane of the recreational board.

FIGS. 1–7 show various embodiments of recreational board carrying device 10 designed for carrying elongate recreation boards and other sporting equipment such as snowboard 60. In preferred embodiments, a first receptacle 20 at the proximal end of carrying device 10 and a second receptacle 50 found at the distal end of carrying device 10. In preferred embodiments of the present invention, receptacles 20 and 50 (See, FIGS. 5A and 5B) each further comprise an anterior surface a posterior surface and sides connecting these the respective surfaces such that each receptacles provides a pocket with an opening, 22 and 52, respectively, capable of receiving and holding the proximal 61 and distal 62 ends of recreational board 60.

In some embodiments of the present invention, receptacles ends 20 and 50 comprise reinforced cut/and or abrasion resistant materials (e.g., metal wire or bands, KEVLAR, and the like). For example, in one embodiment, the present invention further comprises a cut resistant band of material 13 attached (permanently or non-permanently) to interior and/or exterior of proximal end receptacle 20. Likewise, in other embodiments, an additional cut resistant band of material 14 is attached (permanently or non-permanently) to interior and/or exterior of proximal end receptacle 50. In some of these embodiments, the cut resistant materials 13 and 14 increase the theft-deterrence of carrier device 10 when the device is secured around recreational board 60.

Still other embodiments of the present invention comprise an shock dampening/absorbing (e.g., neoprene, foam rubber, and the like) material(s) or a similar protective material at one or both of receptacle ends 20 and/or 50. It is contemplated that the additional of shock dampening/absorbing material at receptacle ends 20 and/or 50 increases the scratch and dent resistance of recreation board carrier 10 when engaging a recreational board 60. In preferred embodiments, shock-dampening material provided at receptacle ends 20 and 50 is selected so as not to interfere with conversion of recreational board carrier 10 into a wearable pack (See, FIGS. 4A and 4B).

In preferred embodiments, receptacle ends 20 and 50 are releasably connected to one another by one or more support members 30 and 40 along the length of the carrier device 10, such that the opening 22 of receptacle 20 is directed towards opening 52 of receptacle 50. The number or arrangement of supports members (e.g., straps) employed does not limit the present invention. For example, in another embodiment, support members are provided in an X-like (See e.g., 7) or cruciform configuration that runs across the posterior and anterior surfaces of recreational board 60. In preferred embodiments of the present invention, support members 30 and 40 each comprises first and second ends. In other preferred embodiments, support members 30 and 40 comprise cut and/or abrasion resistant materials (e.g., nylon, KEVLAR, SPECTRA, metal wire or bands).

In some embodiments, the first ends of support members 30 and 40, respectively, are attached permanently (or releasably) to receptacles 20 and 50 at attachment points 31 and 41, respectively. The type of attachment made at attachment points 31 and 41 depends on the needs of the user and manufacturing considerations. For example, permanent attachment of support members 30 and 40 at attachment points 31 and 41, respectively, can be made by gluing, welding, stitching, and the like, while non-permanent attachment can be made by using snaps, hooks, clasps, VELCRO, etc. In some embodiments, support members 30 and 40 are rolled or folded and stored within the carrying device 10 when the device is not in use.

In preferred embodiments of the present invention, the first receptacle 20 is brought into contact with proximal end 61 of recreational board 60 such that proximal end 61 of recreation board 60 is passed through opening 22 of receptacle 20 and second receptacle 50 is brought into contact with proximal end 62 of recreational board 60 such that proximal end 62 of recreation board 60 is passed through opening 52 of receptacle 50.

As mentioned above, in some embodiments, receptacles 20 and 50 comprise a material with suitable elasticity to firmly but releasably secure ends 61 and 62 of recreational board 60. For example, in some embodiments receptacles 20 and 50 comprise a sturdy, lightweight, flexible material such as canvas, nylon or other synthetic or natural fiber.

In some embodiments of the present invention, the second ends of support members 30 and 40 are releasably engaged to complete locking device 92. In some of these embodiments, locking device 92 comprise releasably joined portion 32, provided at the second end of support member 30, and portion 42, provided at the second end of support member 40. The locking device 92 is not intended to be limited, however, to any particular type of locking device, nor to locking devices comprised of two (or more) marrying portions. Indeed, the present invention contemplates key locks, combination locks, keyless locks, and the like. In still other embodiments, support members 30 and 40 releasably attached by locking device 92 are brought under tension by a tensioning device (e.g., clasp, buckle, etc.) such that proximal receptacle end 20 and distal receptacle end 50 are drawn towards one another about the long axis of carrying device 10 thus securing recreation board 60 within carrying device 10.

Figure 6A:
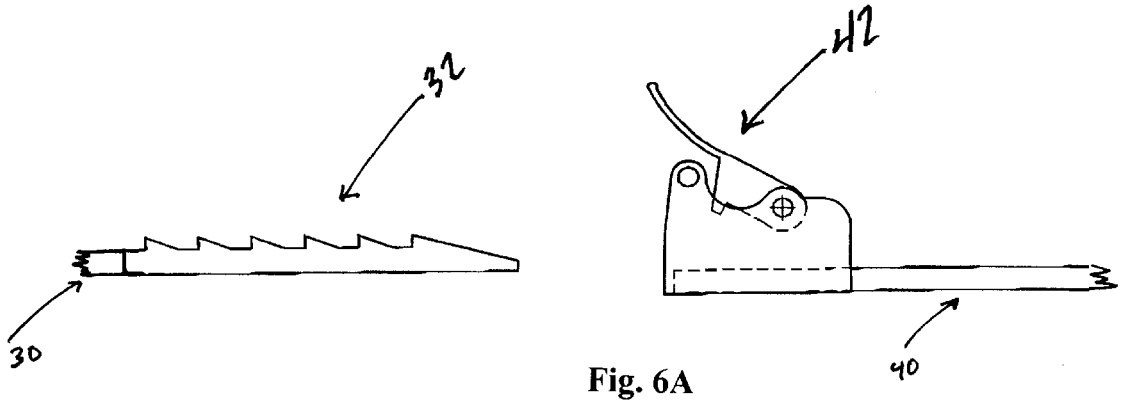
FIGS. 6A and 6B show perspective views of the locking device in the unengaged position (FIG. 6A) and the engaged position (FIG. 6B).
Figure 6B:
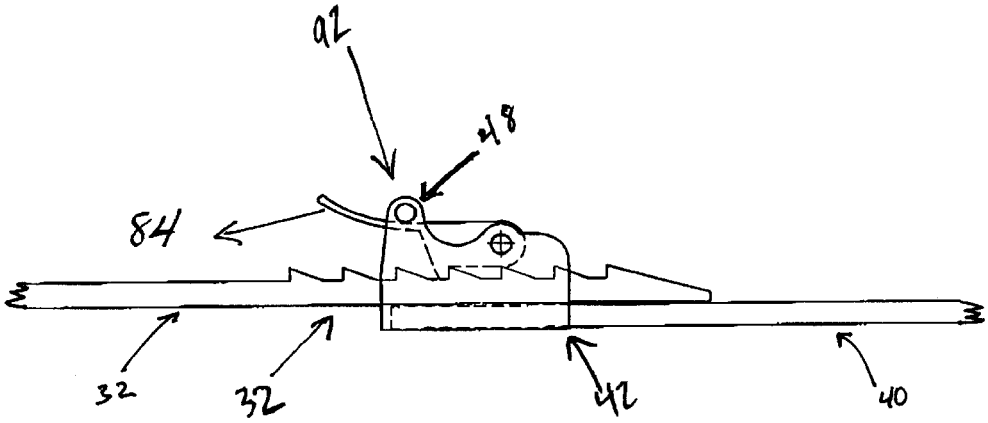

In one preferred embodiment of the present invention, portions 32 and 42 are releasably joined in a ratcheting type engagement by components 84 and 48, respectively, as is well known in the art of ratcheting type engagements to form locking device 92. (FIGS. 6A and 6B).

In preferred embodiments, the dimensions of support members 30 and 40 are tailored such that the proximal receptacle end 20 and distal receptacle end 50 cannot be removed from the ends (61 and 62) of recreational board 60 without first unlocking locking device 92.

In still other preferred embodiments, the present invention comprises an anti-theft leash 70 that can be affixed around stationary objects thus securing the recreation board carrier and anti-theft device 10 and the recreation board 60 carried therein to the object.

In preferred embodiments, the anti-theft leash 70 comprises a cut resistant material (e.g., metal or a suitable synthetic material, such as KEVLAR). In yet other preferred embodiments the anti-theft leash 70 comprises an elongated portion that terminates in a first end 71 and a second end 72. In some of these embodiments, first end 71 of the anti-theft leash 70 comprises a first loop that fits slidingly over the second end of support member 30. Additionally, in some other embodiments, second end 72 of the anti-theft leash 70 comprises a second loop that slidingly fits around the second end of support member 40. Other embodiments of the present invention comprise a locking device at one (or both) the first 71 and second 72 ends of anti-theft leash 70 to releasably attach the respective ends of the anti-theft leash 70 to the support members 30 and/or 40.

Some embodiments of the present invention further comprise carrying strap 33 that allows the user to conveniently distribute the weight of recreation board 60 over their shoulder(s). In preferred embodiments, carrier strap 33 comprise a first end 34 (proximal) and a second end 36 (distal) attached (permanently or non-permanently) to the anterior surface of proximal end receptacle 20 at attachment point 35 and to posterior surface of distal end receptacle 50 at attachment point 37, respectively. Attachment points 35 and 37 comprise permanent or nonpermanent attachments, for example, stitches, glue, welds, snaps, clasps, buckles, and the like. The material selected for carrying strap 33 is selected based upon the following non-limiting considerations, strength, cut and/or abrasion resistance, and manufacturing considerations, as well as aesthetic considerations. It is understood, however, that the present invention is not intended to be limited to providing embodiments compromising one (or more) carrying straps 33.

The present invention contemplates that when carrying device 10 is fitted over recreation board 60 and locking device 92 is engaged thieves are deterred from stealing the recreational board 60 even if the carrying device 10 is not lashed to a stationary object.

In preferred embodiments, carrying strap 33 further comprises a tensioning device (e.g., a buckle) 50 that allows the user to adjust the length of carrying strap 33 for optimal comfort and safety. In still other preferred embodiments, carrying strap 33 comprises a pad 39 that cushions and distributes the weight of recreational board 60 over the user's shoulder(s).

In yet other preferred embodiments, receptacles 20 and 50 nest inside of one another to form a pouch 100 in which the user can place additional items. In some of these preferred embodiments, distal end receptacle 50 nests inside of proximal end receptacle 20. (See, FIGS. 4A and 4B). In some other of these preferred embodiments, carrying strap 33 and/or support members 30 and 40 are used to secure carrying device 10 around the user's waist when not in use (e.g., as a fanny pack). In other embodiments, carrying strap 33 and/or support members 30 and 40 are used to secure carrying device around the user's shoulder(s) when not in use (e.g., as a backpack). Some embodiments provide attachment points 25 and 26 (e.g., loops, snaps, VELCRO fasteners, and the like) for securing carrying strap 33 and/or support members 30 and 40. (See, FIGS. 4A and 4B). In some embodiments of the present invention, proximal end receptacle 20 comprises device (e.g., zipper, buttons, clasp, snaps, VELCRO, and the like) 27 for releasably securing opening 22. In other preferred embodiments, distal end receptacle 50 comprises device (e.g., zipper, buttons, clasp, snaps, VELCRO, and the like) 101 for releasably securing opening 52.

In one embodiment, clasps 77, 78, and 79 releasable engage support members 30 and 40 in order to convert carrying device 10 into a backpack style carrier. In some of these embodiments, support members 30 and 40 (and/or carrying strap 33) are used to secure carrying device 10 through clasps 77, 78, and 79 to convert carrier device 10 into a backpack configuration.

In preferred embodiments, recreational board carrier and anti-theft device 10 is used in the following manner. The user unlocks locking device 92, if locked, such that support members 30 and 40 are free of one another and receptacles 20 and 50 can be spread to receive the ends 61 and 62 of recreational board 60. The user places one receptacle end of carrier device 10 over the recreational board 60 (e.g., opening 22 of proximal receptacle 20 over the proximal end 61 of recreational board 60) such that receptacle 20 fits securely over board end 61. The user then places the other receptacle end (e.g., distal receptacle end 50 and opening 52) over the distal end 62 of recreational board 60.

Support members 30 and 40 are drawn together along the long axis of the carrier device 10 and tensioned sufficiently to prevent removal of recreational board 60 from the carrier device 10. The anti-theft leash 70 is placed around a stable object and the first 71 and second 72 ends of anti-theft leash 70 are slidingly placed over the second ends of support members 30 and 40, respectively. Locking device 92 is releasably engaged by marrying support member 30 terminus 32 with support member 40 terminus 42.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention that are obvious to those skilled in the relevant fields are intended to be within the scope of the following claims.

I claim:

1. A carrying case comprising:

a. a first receptacle located at the proximal end of said carrying case;

b. a second receptacle located at the distal end of said carrying case;

c. a support member comprising an elongated first portion having a first end and a second end, and an elongated second portion having a first end and second end, wherein said first end of said first portion of said support member is attached to said first receptacle, and said first end of said second portion of said support member is attached to said second receptacle;

d. a locking device comprising a first and a second portion, wherein said first portion of said locking device is attached to said second end of said first portion of said support member, and said second portion of said locking device is attached to said second end of said second portion of said support member; and e. a leash comprising an elongated portion and a first end and a second end, wherein said first end of said leash is slidingly attached to said second end of said first portion of said support member, and said second end of said leash is slidingly attached to said second end of said second portion of said support member.

2. The carrying case of claim 1, further comprising f) a carrying strap comprising an elongated portion and a first end and a second end, wherein said first end of said carrying strap is pivotally attached to said first receptacle, and said second end of said support member is pivotally attached to said second receptacle.

3. The carrying case of claim 2, wherein said carrying strap further comprises a device for adjusting the length of said carrying strap.

4. The carrying case of claim 3, wherein said carrying strap further comprises a shoulder pad.

5. The carrying case of claim 1, wherein said first and said second receptacles comprise an elastic material.

6. The carrying case of claim 1, wherein said first and said second receptacles further comprise cut-resistant material.

7. The carrying case of claim 1, wherein said first and said second receptacles further comprise a device for securing said receptacles around the ends of an object.

8. The carrying case of claim 1, wherein said first and said second receptacles further comprise shock absorbing material.

9. The carrying case of claim 1, wherein said carrying case holds a recreational board.

10. The carrying case of claim 9, wherein said recreational board is selected from the group of snowboards, skateboards, surfboards, sailboards, snowshoes, water skis, and snow skis.

11. The carrying case of claim 1, wherein said support member comprises cut-resistant material.

12. The carrying case of claim 1, wherein said leash comprises cut-resistant material.

13. The carrying case of claim 1, further comprising a display of commercial messages.

14. A recreational board carrying case comprising:

a. a first receptacle located at the proximal end of said carrying case;

b. a second receptacle located at the distal end of said carrying case;

c. a support member comprising an elongated first portion having a first end and a second end, and an elongated second portion having a first end and second end, wherein said first end of said first portion of said support member is attached to said first receptacle, and said first end of said second portion of said support member is attached to said second receptacle;

d. a locking device comprising a first and a second portion, wherein said first portion of said locking device is attached to said second end of said first portion of said support member, and said second portion of said locking device is attached to said second end of said second portion of said support member; and e. a leash comprising an elongated portion and a first end and a second end, wherein said first end of said leash is slidingly attached to said second end of said first portion of said support member, and said second end of said leash is slidingly attached to said second end of said second portion of said support member.

15. The recreational board carrying case of claim 14, further comprising f) a carrying strap comprising an elongated portion and a first end and a second end, wherein said first end of said carrying strap is pivotally attached to said first receptacle, and said second end of said support member is pivotally attached to said second receptacle.

16. The recreational board carrying case of claim 14, wherein said recreational board is selected from the group consisting of snowboards, skateboards, surfboards, sailboards, snowshoes, water skis, and snow skis.

17. A carrying case and anti-theft case comprising:

a. a first receptacle located at the proximal end of said carrying case;

b. a second receptacle located at the distal end of said carrying case;

c. a support member comprising an elongated first portion having a first end and a second end, and an elongated second portion having a first end and second end, wherein said first end of said first portion of said support member is attached to said first receptacle, and said first end of said second portion of said support member is attached to said second receptacle;

d. a locking device comprising a first and a second portion, wherein said first portion of said locking device is attached to said second end of said first portion of said support member, and said second portion of said locking device is attached to said second end of said second portion of said support member; and e. a leash comprising an elongated portion and a first end and a second end, wherein said first end of said leash is slidingly attached to said second end of said first portion of said support member, and said second end of said leash is slidingly attached to said second end of said second portion of said support member.

* * * * *